United States Patent [19]

Whiteley

[11] 3,973,479

[45] Aug. 10, 1976

[54] FLOOR-CEILING AIR CIRCULATING DEVICE

[76] Inventor: Isaac C. Whiteley, 1629 S. Canyon Drive, Redmond, Oreg. 97756

[22] Filed: June 23, 1975

[21] Appl. No.: 589,567

[52] U.S. Cl. ..... 98/33 A; 417/249

[51] Int. Cl.[2] ..... F24F 13/06

[58] Field of Search ..... 98/33 R, 33 A; 417/249, 417/362; 137/563, 565

[56] References Cited

UNITED STATES PATENTS

| | | | |
|---|---|---|---|
| 2,080,757 | 5/1937 | Blomberg | 415/198 |
| 3,347,025 | 10/1967 | Wiley | 98/33 R |
| 3,827,342 | 8/1974 | Hughes | 98/33 |

*Primary Examiner*—Kenneth W. Sprague
*Assistant Examiner*—Larry I. Schwartz
*Attorney, Agent, or Firm*—Robert H. Epstein

[57] ABSTRACT

A floor-ceiling air circulating device includes a base adapted to be supported on the floor of a room, a duct assembly extending vertically from the base and defining a flow path between an upper outlet adjacent the ceiling of the room and a lower inlet adjacent the floor of the room and a flow path between an upper inlet near the ceiling and a lower outlet near the floor, and a fan associated with each flow path and housed in the base to stabilize the device. One of the fans draws air from the floor and discharges the air at the ceiling via one flow path and the other fan draws air from the ceiling via the other flow path and discharges the air at the floor such that the air drawn from the floor is replaced with air drawn from the ceiling and vice versa to thereby circulate the air at the floor and at the ceiling and reduce temperature stratification in the room.

12 Claims, 4 Drawing Figures

FIG. 1
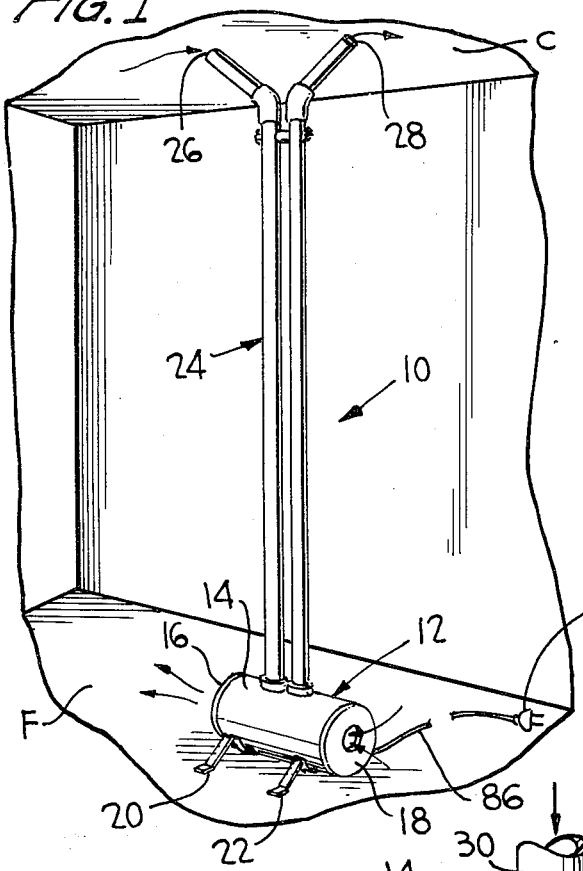
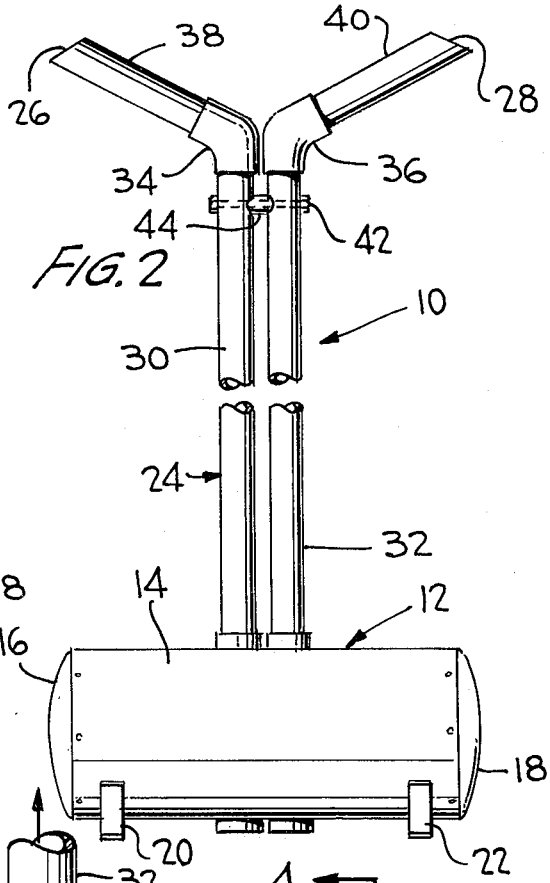
FIG. 2
FIG. 3
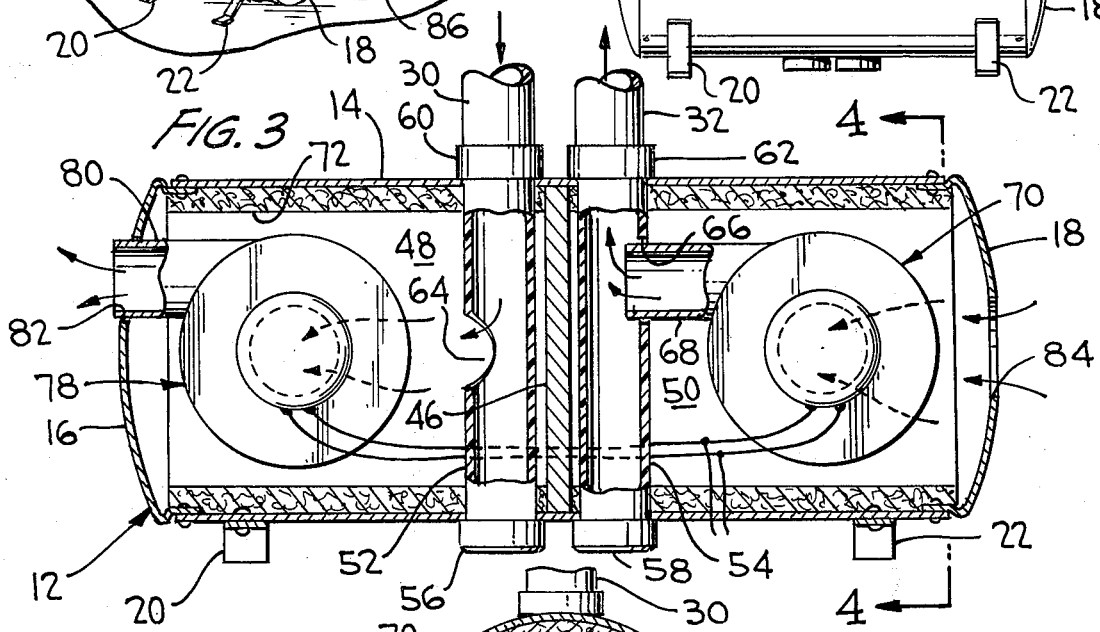
FIG. 4
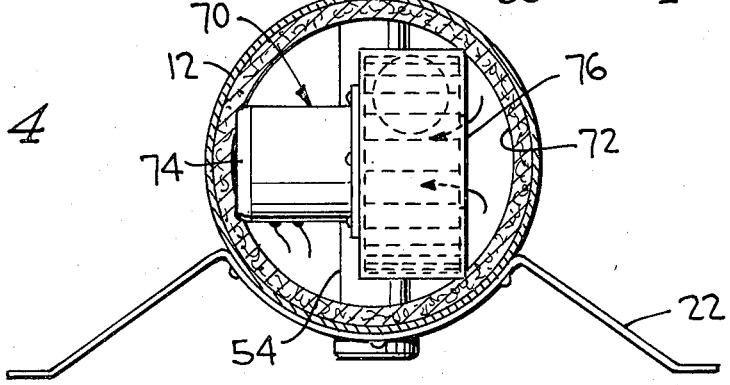

FLOOR-CEILING AIR CIRCULATING DEVICE

BACKGROUND OF THE INVENTION

1. Field of the Invention

The present invention pertains to air circulating devices and, more particularly, to a device for circulating air between the floor and ceiling of a room to reduce temperature stratification and to decrease the energy required to maintain the room at a given temperature.

2. Discussion of the Prior Art

Due to the rising of hot air and the concomitant descending of cold air in a room, the heating or cooling of the room is inefficient and requires more energy than should be expended to maintain a given temperature in the room. That is, the actual living portion of the room which should be maintained at the given temperature is between the floor and the ceiling; however, the temperature differential between the floor and ceiling in a temperature-controlled room is normally from 16° to 24°F. thereby representing a waste of energy in either heating or cooling the room.

Temperature stratification has long been recognized as an obstacle to efficient room temperature control; and, thus, there have been many attempts in the prior art to overcome stratification. Such attempts, as exemplified by U.S. Pat. Nos. 3,347,025 to Wiley and 3,827,342 to Hughes, have conventionally attempted to solve the problem by circulating air at one level to the other level with a fan; however, this only sets up a vertical circulation of air caused by the fan and requires a natural return path for the air through the room. Accordingly, such attempts have not fully solved the problems of temperature stratification.

SUMMARY OF THE INVENTION

It is a primary object of the present invention to overcome the problems of the prior art by providing a floor-ceiling air circulating device wherein air drawn from one level of a room for supply to another level is directly replaced with air from the other level.

Another object of the present invention is to create air circulation at both the ceiling and floor levels of a room while exchanging air between the ceiling and floor levels without requiring a natural return path.

A further object of the present invention is to provide a portable floor-ceiling air circulating device capable of being easily picked up and handled for placement at any desired position in a room, the floor-ceiling air circulating device also being adjustable to permit control over the direction of air flow circulation in accordance with room requirements.

The present invention has yet another object in that a floor-ceiling air circulating device is formed of a self-standing base with a vertical duct assembly mounted thereon to provide direct replacement of air moved between the floor and ceiling of a room via a pair of oppositely directed flow paths in the duct assembly.

The present invention is generally characterized in a floor-ceiling air circulating device including a base adapted to be supported on the floor of a room, a duct assembly extending vertically from the base defining a first flow path extending from a lower inlet at the base and terminating at an upper outlet adjacent the ceiling of the room and a second flow path extending from a lower outlet at the base and terminating at an upper inlet adjacent the ceiling of the room, and fan means housed in the base for drawing air from the floor via the lower inlet and forcing the air through the first flow path for discharge at the upper outlet adjacent the ceiling and drawing air from the ceiling via the upper inlet and the second flow path for discharge adjacent the floor at the lower outlet whereby air drawn from the ceiling is replaced by air drawn from the floor and air drawn from the floor is replaced by air drawn from the ceiling.

Some of the advantages of the present invention over the prior art are that air removed from a level of a room is directly replaced, heating and cooling efficiency is substantially increased and the device is portable, light weight, easily manipulated and inexpensive to produce requiring only a minimum number of parts.

Other objects and advantages of the present invention will become more apparent from the following description of the preferred embodiment taken in conjunction with the accompanying drawings.

BRIEF DESCRIPTION OF THE DRAWINGS

FIG. 1 is a perspective of the floor-ceiling air circulating device of the present invention used in a room.

FIG. 2 is a broken front elevation of the floor-ceiling air circulating device of the present invention.

FIG. 3 is a longitudinal section of the base of the floor-ceiling air circulating device of the present invention.

FIG. 4 is a section taken along line 4—4 of FIG. 3.

DESCRIPTION OF THE PREFERRED EMBODIMENT

A floor-ceiling air circulating device 10 according to the present invention is shown in FIG. 1 and includes a base 12 formed of a cylindrical housing 14 having end plates 16 and 18 secured to opposite open ends thereof and a pair of legs 20 and 22 extending laterally from the housing 14 sufficiently close to the ends to permit the base 12 to be stably supported on a floor F of a room. A duct assembly 24 is mounted on the base 14 and extends upwardly to a ceiling C where the duct assembly terminates in an upper inlet 26 and an upper outlet 28 arranged such that air discharged from the outlet 28 is not directly drawn into the inlet 24.

As best shown in FIG. 2, the duct assembly 24 defines a first flow path formed of a downdraft pipe 30 leading from inlet 26 to the base 12 and a second flow path formed of an updraft pipe 32 leading from the base 12 to outlet 28. The pipes 30 and 32 are formed of vertical plastic tubings 1¼ inches in diameter with the lower ends of the tubings extending into the base and the upper ends of the tubings terminating at elbows 34 and 36 from which 7-inch tubings 38 and 40 extend to the inlet 26 and the outlet 28, respectively, at an angle to the vertical. The pipes 30 and 32 are held in position by a bolt 42 extending through the pipes and a plastic spacer 44 disposed near the elbows 34 and 36. With the vertical and angular parts of the pipes 30 and 32 formed of two pieces, the angular extensions 38 and 40 can be rotated to permit directional adjustment of the inlet and outlet, if desired; however, the pipes 30 and 32 can each be formed of a single length of tubing or the pipes can be integrally formed as a single two-channel duct.

The housing 14 is separated by a partition 46 into chambers 48 and 50, and lower portions 52 and 54 of pipes 30 and 32 extend through the housing 14 adjacent partition 47 in chambers 48 and 50, respectively.

The ends of pipe portions 52 and 54 extending below the housing 14 have plastic caps 56 and 58 secured thereto, respectively, and plastic collars 60 and 62 are secured to pipe portions 52 and 54, respectively, above the housing such that the pipes 30 and 32 are effectively clamped to the housing. The lower portion 52 of pipe 30 has an opening 64 therein communicating with chamber 48, and the lower portion 54 of pipe 32 has an opening 66 therein receiving a tangential flow outlet 68 of an electric, squirrel cage fan 70 mounted in chamber 50. The chambers 48 and 50 are interiorly lined with fiberglass, sound and heat insulating material 72; and, as shown in FIG. 4, the fan 70 is mounted in the chamber 50 by wedging the fan into the chamber 50 with the edges of the electric motor 74 and the rotor housing 76 engaging and extending into the insulating material 72. In a similar manner, an electric, squirrel cage fan 78 is mounted in chamber 48; however, the tangential flow outlet 80 of the fan 78, defining a lower outlet for the device 10, is received in an opening 82 in end plate 16 with air flowing through opening 64 in the pipe to the axial inlet of the fan 78 while air flows to the axial inlet of fan 70 through a central inlet opening 84 in end plate 18, defining a lower inlet for the device 10.

The fans 70 and 78 are small, preferably moving fifteen cubic feet per minute and having dimensions of 4 × 4 × 4 inches, such that the housing 14 is small, for example having a 6 inch diameter and a length of 14 inches. The fans 70 and 78 are wired together in parallel, and a cord 86 extends from the base 12 to a plug 88 for insertion in any conventional electrical receptacle. The housing 14, end plates 16 and 18 and legs 20 and 22 are preferably made of metal while the partition 46 is preferably a ½ inch fiber board. The duct extensions 38 and 40 are 7 inches in length, and the height of the vertical pipe portions of the duct assembly depends upon the ceiling height.

In use, the floor-ceiling air circulating device 10 can be placed in any desirable position in a room to produce floor-ceiling circulation at that point, it being appreciated that the floor-ceiling air circulating device 10 is small and light weight and can be easily picked up and handled by the duct assembly 24 due to its clamping on the base 12. The spread of the legs 20 and 22 renders the device 10 extremely stable and placement of the weight of the fans at the base makes it difficult to tip the device over.

In operation, once the floor-ceiling air circulating device 10 is plugged in, fan 78 will operate to draw air from the level of the ceiling C via inlet 26 and pipe 30 and discharge the air through outlet 80 at the level of the floor F; and, conversely, the fan 70 will operate to draw air from the level of the floor F through opening 84 and discharge the air through outlet 28 at the level of the ceiling C via pipe 32. In this manner, hot air, which rises in the room to the ceiling, is discharged on the floor and cold air, which descends in the room to the floor, is discharged at the ceiling to provide circulation and even temperature distribution without normal stratification. The temperature distribution is achieved directly with the floor-ceiling air circulating device 10 of the present invention in that air drawn from the ceiling is directly replaced with air drawn from the floor and vice versa. The angular orientation of the pipe extensions 38 and 40 assures that air discharged at outlet 28 is not directly drawn into inlet 26; and, similarly, at the base 12 the arrangement of the inlet 84 and outlet 80 assures that air discharged at outlet 80 is not directly drawn into inlet 84. By directly replacing the warm ceiling air with cool floor air and simultaneously directly replacing the cool floor air with warm ceiling air, circulation is established on the floor level and the ceiling level rather than requiring circulation to be naturally established between the floor and ceiling.

As an example, it has been found that in a room having a nominal temperature of 74°F. the floor temperature was 69° while the ceiling temperature was 84°. With the floor-ceiling air circulating device 10, the hot ceiling air is dispersed at the floor level to raise the floor air temperature over a substantial area thereby raising the effective living temperature in the room and saving substantial energy essentially by obviating heating of the ceiling level. That is, since hot air rises in the room, the temperature in the central portion of the room between the floor and ceiling is maintained at a higher level with the same amount of heat supplied to the room when the floor-ceiling air circulating device 10 is used thereby decreasing the heat required to be supplied to the room by approximately 20 percent. In similar fashion, the floor-ceiling air circulating device 10 is effective when the room is being cooled.

By turning the tubing extensions 38 and 40, the flow of air circulating at the ceiling level can be directed at any desired room location thereby permitting the floor-ceiling air circulating device 10 to be adapted to any room configuration and further permitting the flow of air to be changed to optimize effectiveness of the floor-ceiling air circulating device. Additionally, movement of the tubing extensions permits the device 10 to be positioned in any corner of a room. If the pipes 30 and 32 are formed intergrally with the extensions, the entire pipes can be rotated relative to the base to provide flow adjustment.

Inasmuch as the present invention is subject to many variations, modifications and changes in detail, it is intended that all subject matter described above or shown in the accompanying drawings be interpreted as illustrative and not in a limiting sense.

What is claimed is:

1. A floor-ceiling air circulating device comprising base means adapted to be supported on the floor of a room;

duct means extending vertically from said base means defining a first flow path extending from a lower inlet at said base means and terminating at an upper outlet adjacent the ceiling of the room and a second flow path extending from a lower outlet at said base means and terminating at an upper inlet adjacent the ceiling of the room; and fan means housed in said base means for drawing air from the floor via said lower inlet and forcing the air through said first flow path for discharge at said upper outlet adjacent the ceiling and drawing air from the ceiling via said upper inlet and said second flow path for discharge adjacent the floor at said lower outlet whereby air drawn from the ceiling is replaced by air drawn from the floor and air drawn from the floor is replaced by air drawn from the ceiling.

2. A floor-ceiling air circulating device as recited in claim 1 wherein said duct means includes a first pipe defining said first flow path and a second pipe defining said second flow path, said first and second pipes having lower portions mounted on said base means and upper portions extending away from each other to define said upper outlet and said upper inlet.

3. A floor-ceiling air circulating device as recited in claim 2 wherein said first and second pipes are formed of plastic tubing.

4. A floor-ceiling air circulating device as recited in claim 3 wherein said upper portions of said first and second pipes extend at an angle to the vertical.

5. A floor-ceiling air circulating device as recited in claim 4 wherein said first and second pipes have vertical portions and said upper portions are movably connected with said vertical portions to permit adjustment of the circulation flow at the ceiling.

6. A floor-ceiling air circulating device as recited in claim 5 wherein said base means includes a housing having legs extending therefrom to stably support said base means on the floor, said housing having a partition therein defining first and second chambers therein, said first chamber communicating with said lower inlet and said first pipe and said second chamber communicating with said lower outlet and said second pipe, and said fan means includes a first electric fan arranged in said first chamber to draw air from the floor through said lower inlet and force the air through said first pipe to be discharged from said upper outlet at the ceiling and a second electric fan arranged in said second chamber to draw air from the ceiling through said upper inlet and said second pipe and discharge the air through said lower outlet along the floor.

7. A floor-ceiling air circulating device as recited in claim 6 wherein said housing has a cylindrical configuration and has an interior lining of insulating material, and said first and second fans are wedged in said first and second chambers with the edges thereof extending into said insulating material.

8. A floor-ceiling air circulating device as recited in claim 7 wherein said first and second pipes extend through said housing in said first and second chambers, respectively, and have caps on the ends thereof under said housing and collars thereon above said housing to clamp said first and second pipes to said housing.

9. A floor-ceiling air circulating device as recited in claim 1 wherein said base means includes a housing defining first and second chambers, and said duct means includes first and second pipes defining said first and second flow paths, respectively, and extending through said first and second chambers to clamp onto said housing whereby said floor-ceiling air circulating device can be picked up and handled by gripping said pipes.

10. A floor-ceiling air circulating device as recited in claim 9 wherein said pipes are formed of plastic tubing and having plastic caps covering the ends thereof under said housing and plastic collars thereon above said housing to clamp said pipes to said housing.

11. A floor-ceiling air circulating device as recited in claim 1 wherein said base means includes a housing defining first and second chambers communicating with said first and second flow paths, respectively, and each lined with insulating material, and said fan means includes an electric fan wedged in each of said first and second chambers with the edges of each fan extending into said insulating material.

12. A floor-ceiling air circulating device as recited in claim 11 wherein said housing is cylindrical and said base means includes a pair of legs extending laterally from each end of said housing to stably support said base means on the floor.

* * * * *